United States Patent [19]

Justus

[11] Patent Number: 4,495,712

[45] Date of Patent: Jan. 29, 1985

[54] PAPER MAKING MACHINE DRYER SECTION DRIVE

[75] Inventor: Edgar J. Justus, Beloit, Wis.

[73] Assignee: Beloit Corporation, Beloit, Wis.

[21] Appl. No.: 392,720

[22] Filed: Jun. 28, 1982

[51] Int. Cl.[3] ..... F26B 13/08

[52] U.S. Cl. ..... 34/52; 34/121

[58] Field of Search ..... 34/121, 122, 123, 114, 34/116, 52

[56] References Cited

U.S. PATENT DOCUMENTS

| | | | |
|---|---|---|---|
| 1,335,357 | 3/1920 | Warburton | 34/121 |
| 1,558,936 | 10/1925 | Simons . | |
| 1,616,383 | 2/1927 | Malkin . | |
| 1,627,832 | 5/1927 | Carpenter . | |
| 1,760,923 | 6/1930 | Vedder | 34/121 |
| 1,767,606 | 6/1930 | Mortensen . | |
| 2,219,857 | 10/1940 | Weston . | |
| 2,330,891 | 10/1943 | Hornbostel | 34/121 |
| 2,857,682 | 10/1958 | Olden et al. | 34/160 |
| 2,914,864 | 12/1959 | Clem | 34/121 |
| 3,359,646 | 12/1967 | Beachler | 34/121 |
| 3,643,338 | 2/1972 | Fair | 34/116 |
| 3,815,256 | 6/1974 | Ely . | |
| 4,181,039 | 1/1980 | Phelps . | |
| 4,232,257 | 11/1980 | Harshberger | 318/608 |
| 4,290,209 | 9/1981 | Buchanan et al. | 34/123 |

*Primary Examiner*—Larry I. Schwartz
*Assistant Examiner*—David W. Westphal
*Attorney, Agent, or Firm*—Hill, Van Santen, Steadman & Simpson

[57] ABSTRACT

A plurality of electrical driving motors for the rolls in cooperative upper and lower tiers of a paper machine dryer section are coupled with respective dryer rolls in what may be a one-motor-to-one-roll relation, the rolls of each tier being wrapped and synchronized by a dryer felt for that tier. One of the motors of each tier is synchronized with one of the motors of the other tier for synchronizing the running speed of each roll tier with respect to the other roll tier.

11 Claims, 4 Drawing Figures

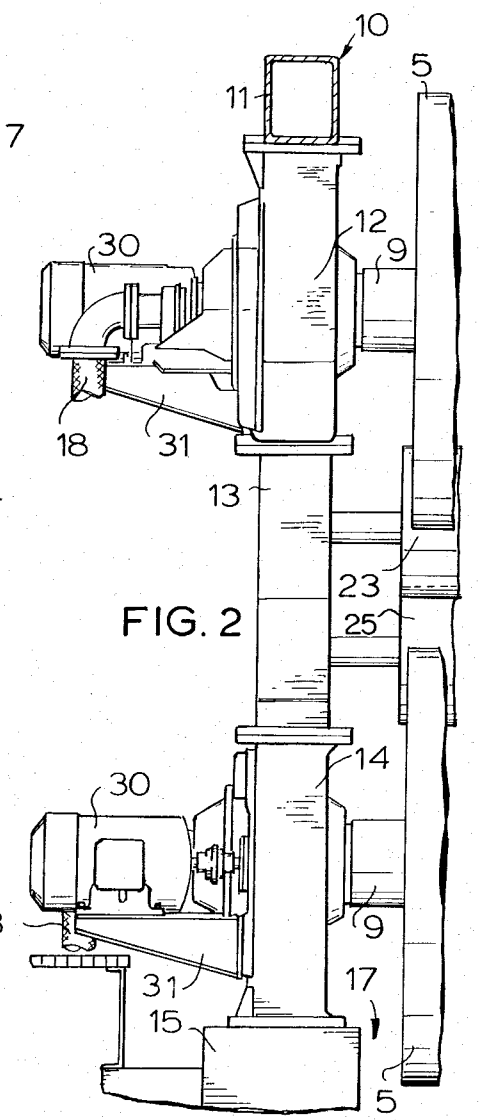
FIG. 2
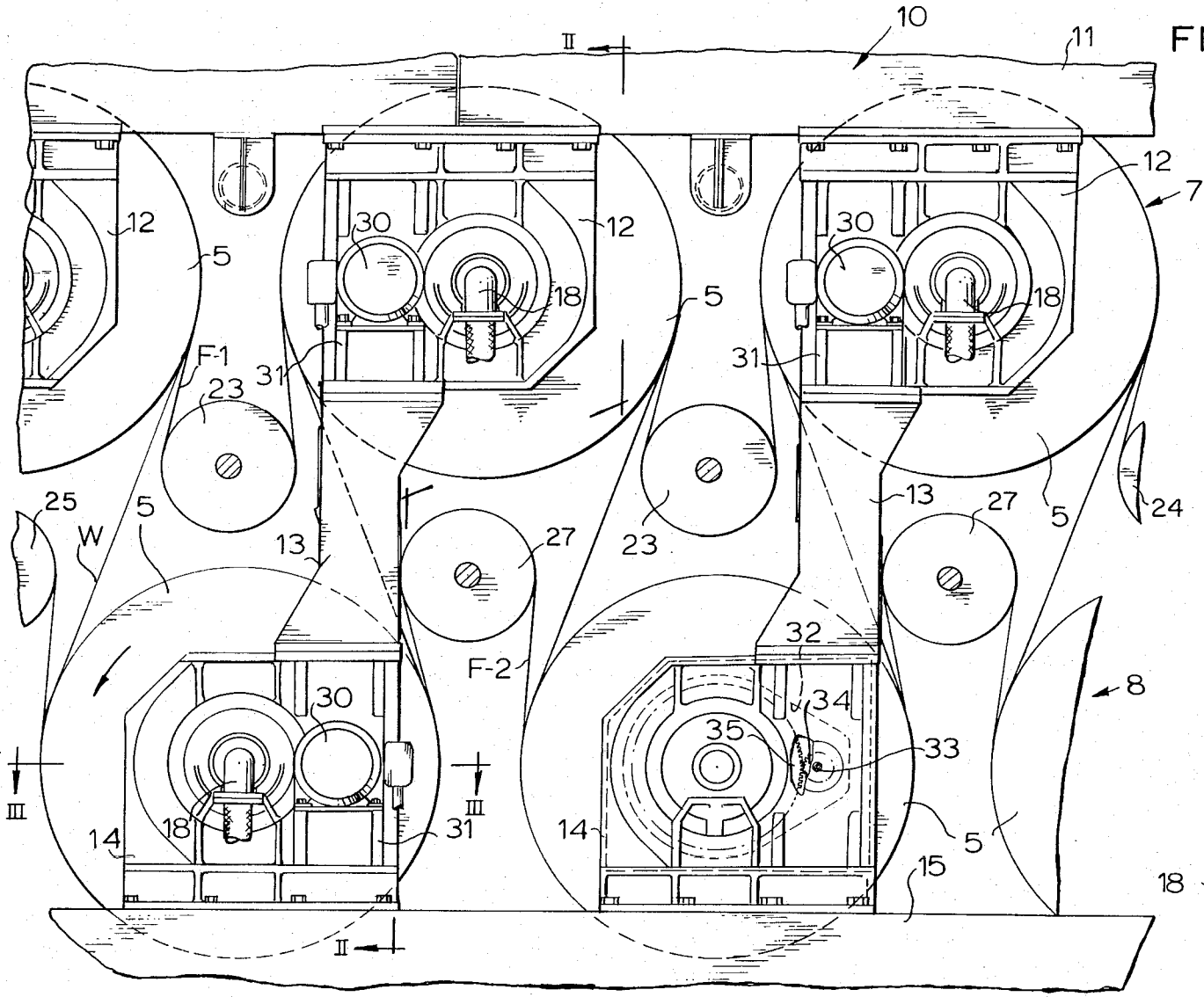

PAPER MAKING MACHINE DRYER SECTION DRIVE

BACKGROUND OF THE INVENTION

1. Field of the Invention

This invention relates to the paper making art and is more particularly concerned with a new and improved paper making machine dryer section drive.

2. Brief Description of the Prior Art

After the paper web has been dewatered in a paper making machine to the extent that it is self-supporting, the web is caused to travel through a dryer section having a plurality of rotatably mounted heated dryer drums or rolls arranged in cooperative upper and lower tiers and over which the paper web to be dried is adapted to travel in a sinuous path successively around the dryer rolls of the tiers. Respective dryer felts guide and hold the web onto the roll peripheral surfaces of each tier. Each dryer felt also functions to maintain substantial synchronism of the dryer rolls in the respective tier with which the felt is associated. Representative of this type of dryer section is the disclosure in U.S. Pat. No. 3,815,256.

In the modern day dryer sections, which may operate at lineal or machine direction speeds of about 3000 feet per minute, it has been customary to drive the entire dryer section by means of one large driving motor and then through a long train of gears at the backside of the machine, all of the dryer rolls, which may be as many as 15 in a typical dryer section, are driven in unison from the single motor. This requires a fairly massive and costly frame and gearbox arrangement, which interferes with symmetrical air flow from the paper machine basement, in contrast to the front side of the dryer section which is not encumbered with the gear box structure. Because of the large number of gears in the train, considerable operating noise is generated. Customarily, the gears are lubricated with oil and oil leakage can be a problem.

SUMMARY OF THE INVENTION

An important object of the present invention is to provide a new and improved dryer section drive which will overcome the disadvantages, drawbacks, inefficiencies, shortcomings and problems inherent in prior dryer section drives.

To this end, the present invention provides in a paper machine dryer section of the type having a plurality of rotatably mounted heated dryer rolls arranged in cooperative upper and lower tiers and over which a paper web to be dried is adapted to be run in a sinuous path successively around the dryer rolls of the tiers, and respective dryer felts for guiding and holding the web onto the dryer roll peripheral surfaces in each tier, said felts also functioning to maintain substantial running speed synchronism of the rolls in respective tier with which each felt is associated, the improvement comprising each tier of rolls having a plurality of electrical driving motors for driving exclusively the rolls in that tier; means for effecting a driving coupling for the motors in each tier with the respective dryer rolls in that tier; and means for synchronizing one of the motors of each tier with one of the motors of the other tier for synchronizing the running speed of each roll tier with respect to the other roll tier.

There is also provided by the present invention a method of operating and controlling a paper machine dryer section of the type having a plurality of rotatably mounted heated dryer rolls arranged in cooperative upper and lower tiers and over which a paper web is run in a sinuous path successively around the dryer rolls of the tiers, and respective dryer felts guiding and holding the web onto the dryer roll peripheral surfaces in each tier, said felts also functioning to maintain substantial running speed synchronism of the rolls in the respective tier with which each felt is associated, the improvement comprising driving the rolls in each tier by means of a plurality of electrical driving motors exclusively for that tier; effecting a driving coupling of the motors in each tier with the dryer rolls in that tier; and synchronizing one of the motors of each tier with one of the motors of the other tier and thereby synchronizing the running speed of each roll tier with respect to the other roll tier.

Other objects, features and advantages of the invention will be readily apparent from the following description of a representative embodiment thereof, taken in conjunction with the accompanying drawings, although variations and modifications may be effected without departing from the spirit and scope of the novel concepts embodied in the disclosure and in which:

BRIEF DESCRIPTION OF THE DRAWINGS

FIG. 1 is a fragmentary elevational view of the back side of a paper machine dryer section embodying the invention;

FIG. 2 is a vertical sectional elevational view taken substantially along the line II—II of FIG. 1;

DETAILED DESCRIPTION

Figure 3:
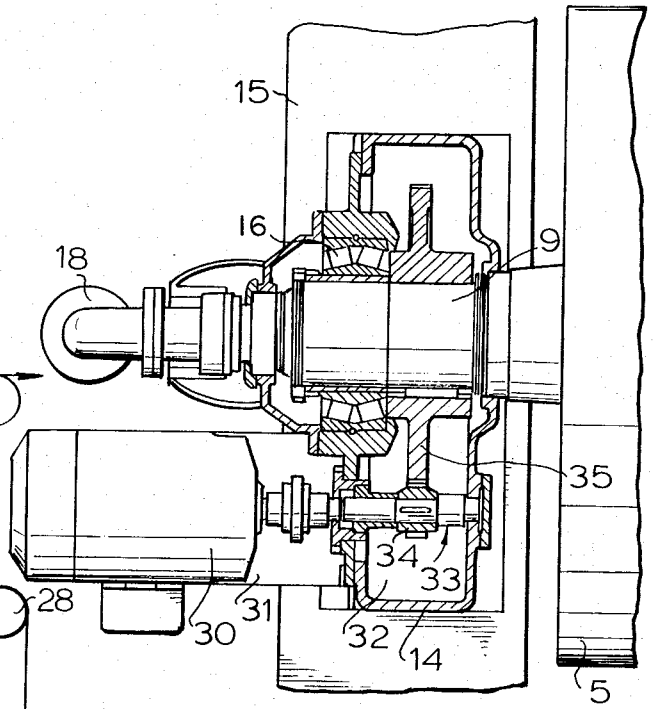
FIG. 3 is an enlarged horizontal sectional detail view taken substantially along the line III—III of FIG. 1.

A paper machine dryer section of the type with which the present invention is particularly concerned, comprises (FIGS. 1 and 4) a plurality of rotatably mounted heated dryer drums, cylinders or rolls 5 arranged in cooperative staggered relation in upper and lower tiers 7 and 8, respectively, and over which a paper web W to be dried is adapted to be run in a sinuous path successively wrapping the dryer rolls of the tiers 7 and 8, as shown. Although only three of the rolls 5 are depicted, for purposes of illustration, in each of the tiers 7 and 8, it will be understood that a larger number of rolls may be used in each tier to meet operating requirements for the particular dryer installation. The rolls 5 may be for example, about 72 inches in diameter and of a length to handle a paper web about 30 feet wide, running at about 3000 feet per minute.

Each of the rolls 5 has axially oppositely projecting hollow shaft means providing journals 9 (only journals at the back side of the dryer section being shown) by which the rolls 5 are adapted to be rotatably journalled for operation within dryer section frame means 10 including longitudinally extending, that is in the machine direction, upper beams 11, only the rear or back side beam being shown. Respective bearing hanger structures 12 secured to the beams 11 provide support for the journals 9 of the upper tier rolls 5. Vertical frame columns 13 extend supportingly between the hanger structures 12 and bearing block structures 14 mounted on foundation beam means 15 and adapted for journalling the journals 9 of the rolls 5 in the lower tier 8. Bearings 16 (FIG. 3) are provided for the journals 9 of the several rolls 5 in each tier. Drying air is adapted to move upwardly from a basement 17 (FIG. 2).

In a well known manner, each of the dryer rolls 5 is heated by means of heating fluid such as steam from suitable source supplied through a respective steam intake 18 connected to the hollow journal 9 at one end, and spent steam may be exhausted through the opposite shaft end (not shown).

Figure 4:
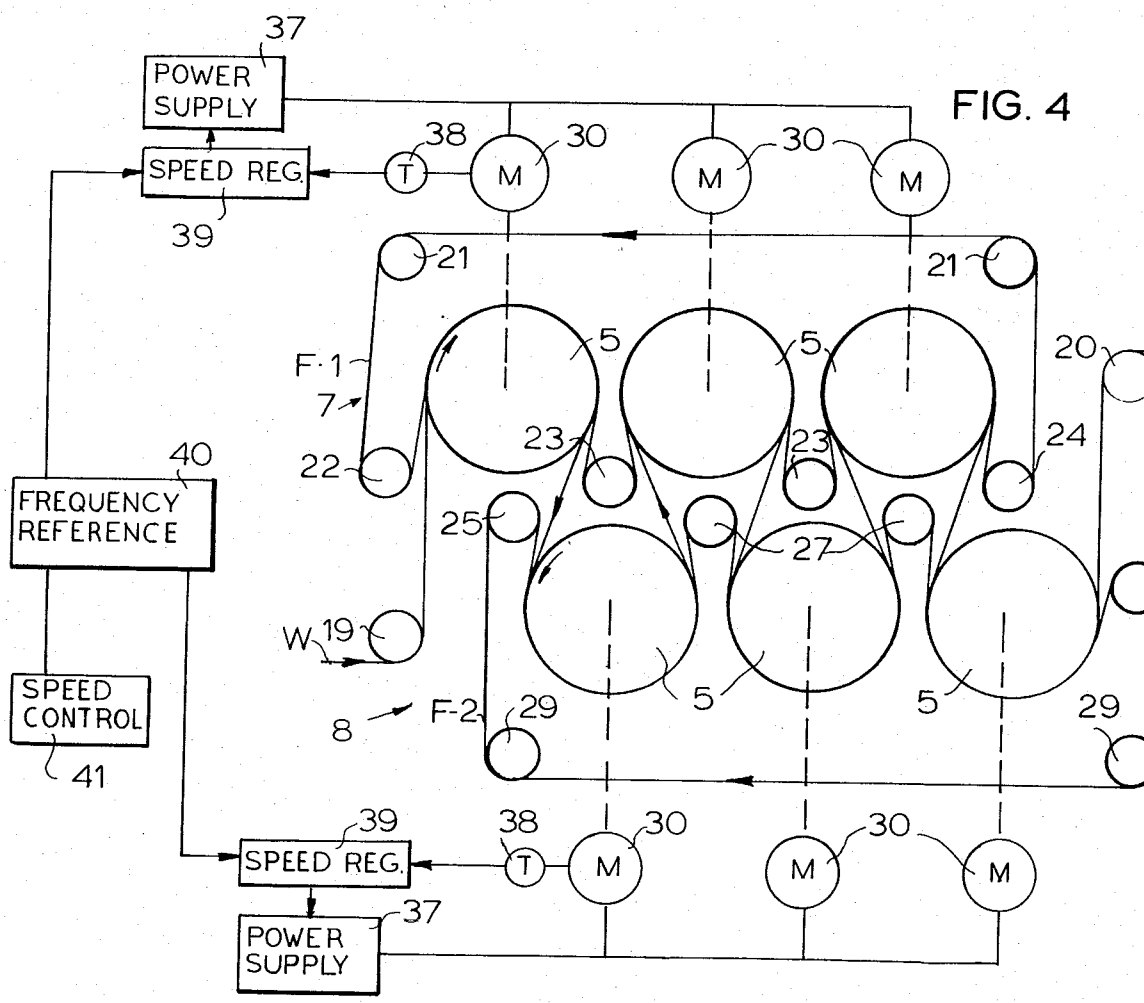
FIG. 4 is a diagrammatic view depicting the dryer section drive and control system.

The wet web W is guided by means of a roller 19 onto the first in the series of one of the tiers of dryer rolls 5, shown in FIG. 4 as the first roll 5 in the upper tier 7, and then travels successively in a serpentine path down from the upper tier dryer roll 5 to the adjacent lower tier dryer roll 5 and then up to the next upper tier roll 5, and so on until the web leaves the dryer section 10 by way of a guide roller 20.

In travelling over the upper tier dryer rolls 5, the web W is held onto the individual dryer drum peripheral surfaces by an endless dryer felt F-1 formed of a porous material which may be of any type fabric suitable for the purpose and which will allow air and steam to pass through it. Above the upper tier 7 the felt F-1 runs over guide rollers 21, and is guided toward the first in the upper tier series of dryer rolls 5 by a guide roller 22. Between the upper tier rolls 5, the felt F-1 is guided serpentine fashion over felt guiding and tensioning rollers 23 in a manner to effect efficient wrapping of each of the dryer rolls 5 and thus efficient contact of the web with the outer peripheries of the dryer rolls. From the last of the upper series dryer rolls 5, the felt F-1 is guided into its return run by a guide roller 24.

In similar fashion, an endless dryer felt F-2 wraps the dryer rolls 5 of the lower tier 8. A guide roller 25 guides the felt F-2 onto the first in the series of lower tier dryer rolls 5. Between the dryer rolls 5, felt guiding rollers 27 maintain wrapping tension on the dryer felt F-2. At the end of the lower tier roll series, a guide roller 28 guides the felt F-2 toward a return run where it travels over guide rollers 29.

Both of the felts F-1 and F-2 are of full machine width, that is, at least the full width of the web W to be dried, and thus of a width equal to substantially the full length of the dryer rolls 5. Accordingly, by maintaining adequate tension throughout the travel of each of the felts, including the return runs, the felts have large torque or power capability in each of the tiers 7 and 8 of the dryer. The modulus of the felts is much greater than the modulus of the web W and, therefore, the felts by reason of their tensioned wrap on the rolls 5 are capable of maintaining synchronous speed of the dryer rolls in each tier well within the stretchable range of the paper web W.

According to the present invention, driving of the dryer rolls 5 in each of the tiers 7 and 8 is effected by means of a plurality of electrical driving motors 30. Means are provided for effecting a driving coupling for each of the motors 30 individually with a respective dryer roll 5 in a one-motor-to-one-roll relation. Although as shown, one of the motors 30 is provided for each of the dryer rolls 5, if the circumstances of operating conditions permit, less than a motor for each roll may be sufficient. For example, each alternate dryer roll 5 may be provided with a driving motor 30. In any event, each of the motors 30 is mounted on a motor bracket 31 supported by the hanger structure 12 in respect to the upper tier dryer rolls 5 and supported by the bearing block structures 14 in respect to the lower tier dryer rolls 5. In a practical arrangement, the motor brackets 31 for the upper and lower tier motors are generally aligned vertically in respect to the associated column 13. This provides a compact arrangement affording maximum open area between the column oriented hanger and bearing block and motor mount structures, greatly simplifying the back side of the dryer section 10 and affording substantially symmetrical air flow from the paper machine basement in respect to both the front and back of the dryer section 10.

Each of the motors 30 is adapted to be coupled in driving relation with its dryer roll 5 in identical fashion to each other motor/dryer roll assembly, and therefore the disclosure in FIG. 3 may be taken as typical. Each of the bearing hangers 12 and bearing blocks 14 provides a gear housing chamber 32. The associated motor 30 has its drive shaft 33 journalled in spaced walls defining the chamber 32. The motor drive shaft 33 has keyed thereto a pinion 34 which meshes with a drive gear 35 which is keyed to the associated roll journal 9. By having all of the drive couplings throughout both tiers of dryer rolls 5 of the same gear ratio, all of the rolls may be driven at the same speed. In each of the tiers 7 and 8, of course, synchronism is maintained in respect to the rolls 5 of each tier by the respective felt F-1 or F-2.

Due to any of a number of inevitable variables, there may be a tendency for either of the tiers 7 or 8 to drift from synchronism with the other tier. To alleviate any such tendency, control means are provided for synchronizing one of the motors 30 of each of the tiers 7 and 8 with one of the motors of the other tier for synchronizing the running speed of each roll tier with respect to the other roll tier. In one practical arrangement as represented in FIG. 4, each of the motors 30 of each tier is connected with a power supply 37 common to the motors of that tier. One of the motors 30 of each tier is connected through a tachometer 38 or other speed sensing device for reacting through a speed regulator 39 and the power supply 37 for controlling the speed of the dryer rolls 30 of that tier. The power supply 37 may be either variable voltage D.C. or variable frequency A.C., but variable frequency A.C. is preferred, because then the individual drive motors 30 may be induction motors, and the voltage will vary directly with frequency. Since all of the motors in each tier are in parallel relation, the associated dryer felt F-1 or F-2, as the case may be, will provide practical synchronism of the motors and dryers in each of the tiers.

To attain constant synchronism of each of the tiers 7 and 8 with respect to the other tier, a frequency reference 40 is provided for comparing frequency feedback from each tier group through the speed regulators of the tier groups. By thus assuring synchronous relationship of the two tiers of dryer rolls, the dryer will function well within the stretchable range of the paper web W and the web will not break in the runs between the rolls 5 of the two tiers. The entire dryer section 10 can start up and run from standstill in a synchronous manner to accommodate threading of a new web into the dryer section and the dryer section then caused to accelerate to full speed. Desirably, a draw adjustment or speed control device 41 is operatively connected with the frequency reference means 40.

From the foregoing, it will be apparent that the present invention affords numerous improvements and advantages, among which may be mentioned elimination of costly and complex gearing, and much simpler framing at the back of the dryer section. Savings are effected even during erection of the apparatus because less erection time will be required. Since individual drive motors are provided for the dryer rolls, no foundation for a large and heavy drive motor is required as has been prior practice. Accessibility to the back of the machine and air flow is much improved. A much simplified oil system is feasible. Dryer roll spacing is flexible and adjustments can be effected without regard to gear train involvement. Expansion joints and backlash provisions usually involved with gear train drives are eliminated.

It will be understood that variations and modifications may be effected without departing from the spirit and scope of the novel concepts of this invention.

I claim as my invention:

1. In a paper making machine dryer section of the type having a plurality of rotatably mounted heated dryer rolls arranged in cooperative upper and lower tiers each having a drum surface over which a paper web to be dried is adapted to be run in a sinuous path successively around the dryer rolls of the tiers, and respective dryer felts for guiding and holding the web onto the dryer roll peripheral surfaces in each tier, said felts also functioning to maintain substantial drum surface running speed synchronism of the rolls in the respective tier with which each felt is associated, the improvement comprising:

each tier of rolls having a plurality of electrical driving motors for driving exclusively the rolls in that tier;

means for effecting a driving coupling for the motors in each tier with the respective dryer rolls in that tier;

and means for synchronizing only one of the motors of each tier with only one of the motors of the other tier for synchronizing the drum surface running speed of each roll tier with respect to the other roll tier.

2. A dryer section according to claim 1, wherein a frame includes upper beam means having support structure for rotatably supporting the dryer rolls of the upper tier, base means having thereon support structures for rotatably supporting the dryer rolls of the lower tier, an upright column connected to and between each of the roll support structures for the upper tier dryer rolls and the subjacent lower tier dryer roll structures, mounts associated with said upper tier dryer roll support structures for the motors of the upper tier and mounts associated with said lower tier dryer roll support structures for the motors of the lower tier, said mounts being generally aligned with said column structures.

3. A dryer section according to claim 2, wherein said support structures have gear housing chambers, said motors having driveshafts within said chambers, pinions on said driveshafts, and said rolls having journals in said chambers carrying drive gears meshing with said pinions.

4. A dryer section according to claim 1, wherein said means for synchronizing comprises a frequency reference device connected to respective speed regulators for the motors of each tier.

5. A dryer section according to claim 4, including a tachometer connected between each of the speed regulators and said one of the motors for each tier.

6. A dryer section according to claim 4, including a speed control connected to said frequency reference device.

7. A dryer section according to claim 4, including a respective power supply common to all of the motors in each tier, and said speed regulator for each tier controlling all of the motors in its tier through said power supply for that tier.

8. A method of operating and controlling a paper machine dryer section of the type having a plurality of rotatably mounted heated dryer rolls arranged in cooperative upper and lower tiers and over which a paper web is run in a sinuous path successively around the dryer rolls of the tiers, and respective dryer felts guiding and holding the web onto the dryer roll peripheral surfaces in each tier, said felts also functioning to maintain substantial running speed synchronism of the peripheral surfaces of the rolls in the respective tier with which each felt is associated, the improvement comprising:

driving the rolls in each tier by means of a plurality of electrical driving motors exclusively for that tier;

effecting a driving coupling of the motors in each tier with the dryer rolls in that tier;

and synchronizing only one of the motors of each tier with only one of the motors of the other tier and thereby synchronizing the running speed of the peripheral surface of each roll tier with respect to the other roll tier.

9. A method according to claim 8, comprising effecting said synchronizing by referencing frequency from a speed regulator for the motors of each tier.

10. A method according to claim 8, which comprises in each tier regulating the speed of the motors of that tier through a common power supply.

11. A method according to claim 8, comprising effecting said synchronizing by referencing the frequency from each of said one motor of each tier through a speed regulator and a tachometer for each tier, and in response to said referencing controlling power supply to the motors of each tier.

* * * * *